United States Patent [19]

O'Keefe

[11] Patent Number: 4,854,656

[45] Date of Patent: Aug. 8, 1989

[54] JEWELRY STORAGE APPARATUS

[76] Inventor: Ellen O'Keefe, 705 R St., Pt. Townsend, Wash. 98368

[21] Appl. No.: 186,308

[22] Filed: Apr. 26, 1988

[51] Int. Cl.[4] ..... A47B 88/00

[52] U.S. Cl. ..... 312/345; 211/13; 312/309

[58] Field of Search ..... 312/317 R, 317 A, 345, 312/348, 311, 309; 70/38 B, 139; 211/94, 13, 162

[56] References Cited

U.S. PATENT DOCUMENTS

| | | | |
|---|---|---|---|
| 772,020 | 10/1904 | Baruch | 312/317 R |
| 1,010,694 | 12/1911 | Shannon | 312/317 R X |
| 1,281,923 | 10/1918 | Fales | 312/345 X |
| 1,305,210 | 5/1919 | Hankwitz | 211/94 X |
| 2,211,308 | 8/1940 | Wyman | 312/317 R |
| 2,327,761 | 8/1943 | Brodbeck | 312/330 X |
| 2,419,013 | 4/1947 | Ducey | 70/38 B |
| 2,758,904 | 8/1956 | Hansell et al. | 312/311 X |
| 3,190,712 | 6/1965 | Fielden | 312/311 |
| 3,592,343 | 7/1971 | Swett | 211/13 |
| 4,314,733 | 2/1982 | Smith | 312/311 X |

*Primary Examiner*—Kenneth J. Dorner
*Assistant Examiner*—Thomas A. Rendos
*Attorney, Agent, or Firm*—Leon Gilden

[57] ABSTRACT

A jewelry storage apparatus for the tangle-free and orderly storage of necklaces, earrings, and the like is set forth. Jewelry is positionable within the apparatus on one of a plurality of elements, such as openings for earrings, and hooks positioned a distance above a floor of the apparatus for tangle-free and dust-free orderly securement of the jewelry. A cabinet-like member is securable to a vertical wall or support surface with a slidable rack reciprocatable therefrom having secured thereto a horizontal rack having formed thereto the aforenoted hooks and earring post openings. An alternative embodiment of the invention includes an addition to wall hanging openings formed within a rear wall of the rack, a "U" shaped hook latchable within the container for securement about a typical coat rack, as is found in motel closets, for securedly attachment of the apparatus during travel by users thereof.

1 Claim, 7 Drawing Sheets

JEWELRY STORAGE APPARATUS

BACKGROUND OF THE INVENTION

1. Field of the Invention

The field of invention relates to jewelry container apparatus and more particularly pertains to a new and improved jewelry storage and container apparatus for permanent securement to a wall or similar vertical support surface or alternatively transportable and selectively securable to horizontal clothing racks for temporary storage of said apparatus during travel by users thereof.

2. Description of the Prior Art

The use of jewelry storage within various containers is well known in the prior art. Containers of this type are of multi-purposes such as convenience in the orderly arrangement of various jewelry. In the past, however, these containers are conspicuous and of relatively easy targets for unauthorized tampering by individuals, children, and the like. An early example of a jewelry-type storage container is set forth in U.S. Pat. No. 549,970 to Lawrence wherein various pins and hooks are arranged longitudinally of a container's interior for the stretching of necklaces and the like therebetween to maintain such necklaces in a tangle-free relationship to one another for storage thereof. The Lawrence patent is of interest relative to an early recognized need for maintaining jewelry and the like in an orderly and convenient relationship to one another but lacks the refinements of the instant invention in maintaining a tamper proof, and dust-free organization for maintaining jewelry in an orderly fashion.

U.S. Pat. No. 4,058,356 to Michal sets forth a jewelry container whereby a plurality of hooks are formed on each of a plurality of pivotal doors formed in a generally vertically oriented jewelry box with a central pivotal post formed with radial arm extending therefrom for the positioning of necklaces and the like thereon wherein the Michal patent is of interest relative the recognized need for maintaining an orderly arrangement of various jewelry types, but it is of a structure and function falling short of the ability of the instant invention to not only maintain a plurality of various jewelry organization in an orderly arrangement but maintain security of same during home and traveling by individuals utilizing the instant invention.

U.S. Pat. No. 732,089 to Lanzen sets forth another early example of a jewelry support apparatus wherein essentially an open-topped relatively flat support tray has positioned therein a plurality of hooks and arrangements for securing a like plurality of rings therein for organizing a large number of such rings in a manageable organization.

U.S. Pat. No. 4,324,446 to LeSage sets forth a jewelry container wherein a plurality of hooks and posts are positioned upon each of a plurality of doors pivotally mounted to a central compartment wherein the LeSage patent provides transparent members mounted overlying door mounted necklaces and the like for maintaining such necklaces in an orderly relationship. The LeSage patent recognizes again the need for orderly and secure arrangement of various jewelry types but lacks the portability of the instant invention in its securement to various horizontal coat racks and the like, as may be found in overnight accommodations such as motels by travelers.

U.S. Pat. No. 4,413,736 to Nibling sets forth a still further example of a jewelry box wherein a selectively attachable frame-like member for disguising the nature of the jewelry box for securement therebehind is generally in the form of a picture frame to thwart would-be intrusion into the jewelry box of the Nibling patent, but is of a structure relatively remote to that of the instant invention.

As such, it may be appreciated that there is a continuing need for a new and improved jewelry storage apparatus that addresses both the problem of maintaining order between a plurality of jewelry classes and further includes means for attachment to a vertical wall surface or selectively attachable to horizontal support bars, as may be found in various temporary accommodations, such as motels and the like, during travel by users of the instant invention.

SUMMARY OF THE INVENTION

In view of the foregoing disadvantages inherent in the known types of jewelry storage apparatus now present in the prior art, the present invention provides an jewelry storage apparatus wherein the same may be effectively secured to a vertical wall surface or alternatively to a typical horizontally mounted clothes rack for easily and effectively securing said apparatus during travel by users of the apparatus. As such, the general purpose of the present invention, which will be described subsequently in greater detail, is to provide a new and improved jewelry storage apparatus which has all the advantages of the prior art jewelry storage apparatus and none of the disadvantages.

To attain this, the present invention comprises a vertically oriented container including a plurality of wall mounting openings for attachment of the container to a vertical wall surface with a slidable rack reciprocatably positionable from interiorly of said container to expose a plurality of hooks secured to a horizontal beam connecting opposite ends of the reciprocating rack positionable within said container. The beam contains a plurality of openings for positioning of earrings and the like therethrough wherein said beam is mounted in an upward terminal end of said rack for enabling the hanging of elongate necklaces and the like therefrom wherein a lower surface of said rack has vertical stop plates integrally secured to a floor of the rack for positioning of miscellaneous jewelry thereon. A further modification of the instant invention includes a spring-loaded latch mechanism of generally "U" shaped configuration for selective securement about a horizontal support clothes type rack or equivalent horizontally mounted bar for selective attachment of said apparatus thereto.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved jewelry storage apparatus which has all the advantages of the prior art jewelry storage apparatus and none of the disadvantages.

It is another object of the present invention to provide a new and improved jewelry storage apparatus which may be easily and efficiently manufactured and marketed.

It is a further object of the present invention to provide a new and improved jewelry storage apparatus which is of a durable and reliable construction.

An even further object of the present invention is to provide a new and improved jewelry storage apparatus which is susceptible of a low cost of manufacture with regard to both materials and labor, and which accordingly is then susceptible of low prices of sale to the consuming public, thereby making such jewelry storage apparatus economically available to the buying public.

Still yet another object of the present invention is to provide a new and improved jewelry storage apparatus which provides in the apparatuses and methods of the prior art some of the advantages thereof, while simultaneously overcoming some of the disadvantages normally associated therewith.

Still another object of the present invention is to provide a new and improved jewelry storage apparatus wherein the same may be secured to a vertical support surface or alternatively to a horizontally mounted bar by utilization of a generally "U" shaped latch means selectively securable interiorly of said apparatus.

Yet another object of the present invention is to provide a new and improved jewelry storage apparatus including a container formed with a reciprocating rack telescopingly positionable exteriorly of said container including a beam formed with integral hooks and openings for attachment of various jewelry thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
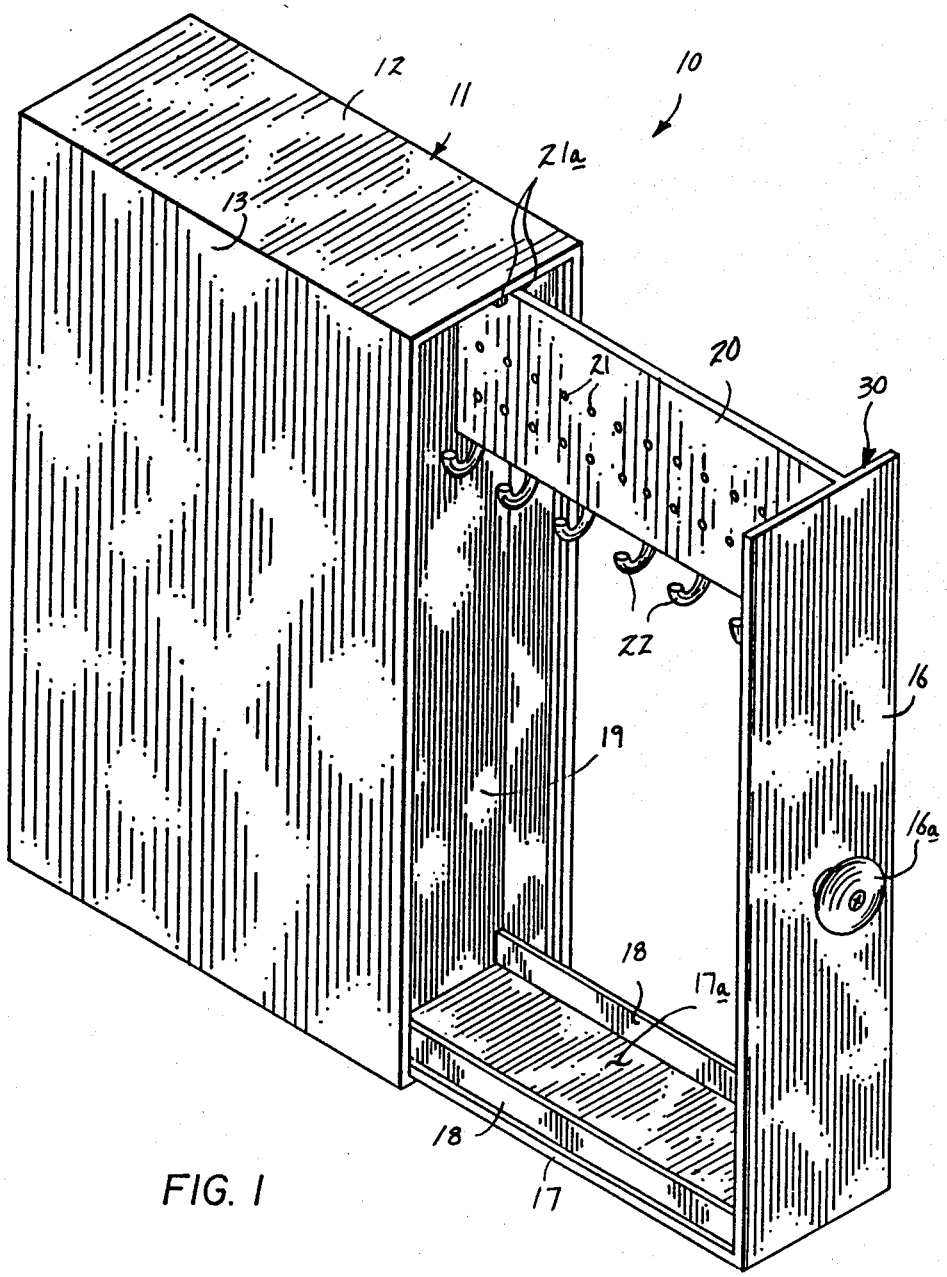
FIG. 1 is an isometric illustration of the instant invention.
Figure 2:
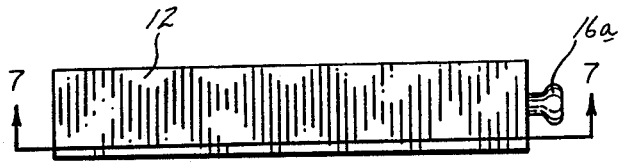
FIG. 2 is a top orthographic view of the instant invention.
Figure 3:
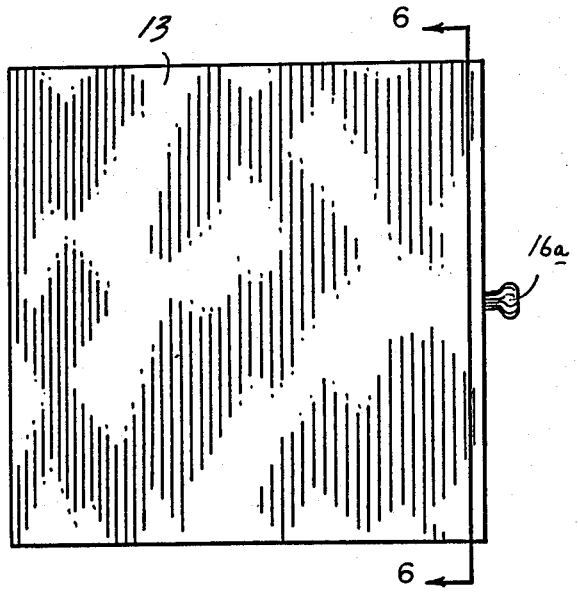
FIG. 3 is an orthographic view taken in elevation of the instant invention.
Figure 4:
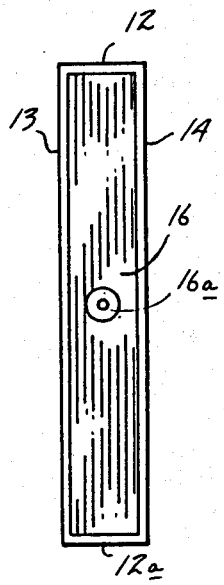
FIG. 4 is an end orthographic view taken in elevation of the invention as illustrated in FIG. 3.

With reference now to the drawings, and in particular to FIGS. 1 to 17 thereof, a new and improved jewelry storage apparatus embodying the principles and concepts of the present invention and generally designated by the reference numerals 10 and **10*a*** will be described.

Figure 5:
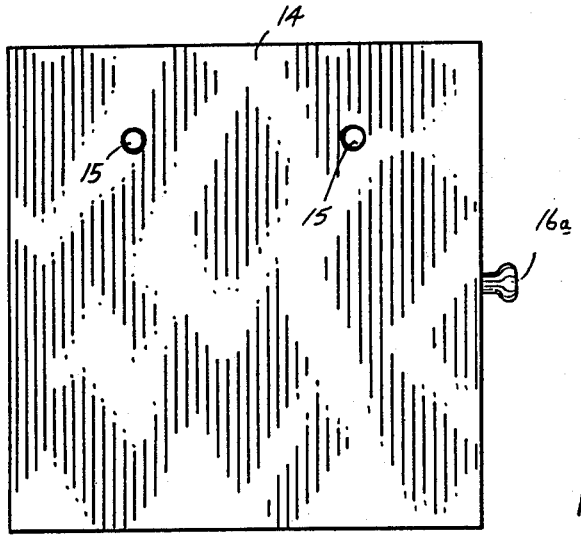
FIG. 5 is a rear orthographic view taken in elevation of the instant invention.
Figure 7:
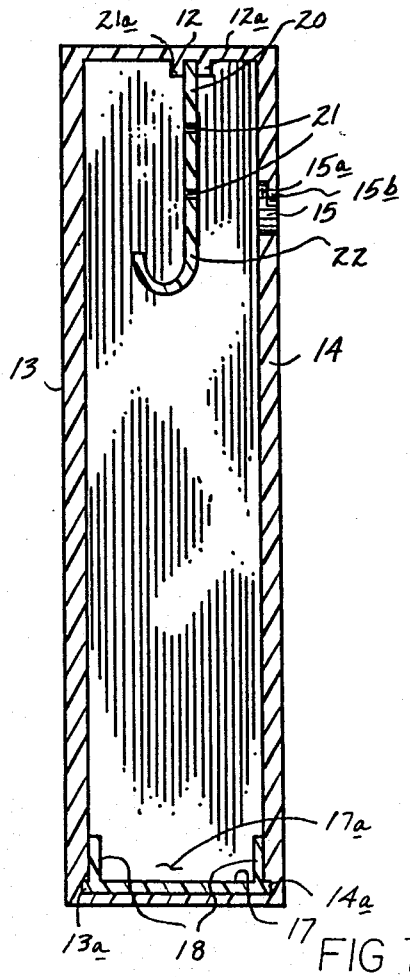
FIG. 7 is an orthographic view taken along the lines 7—7 of FIG. 2 in the direction indicated by the arrows.
Figure 6:
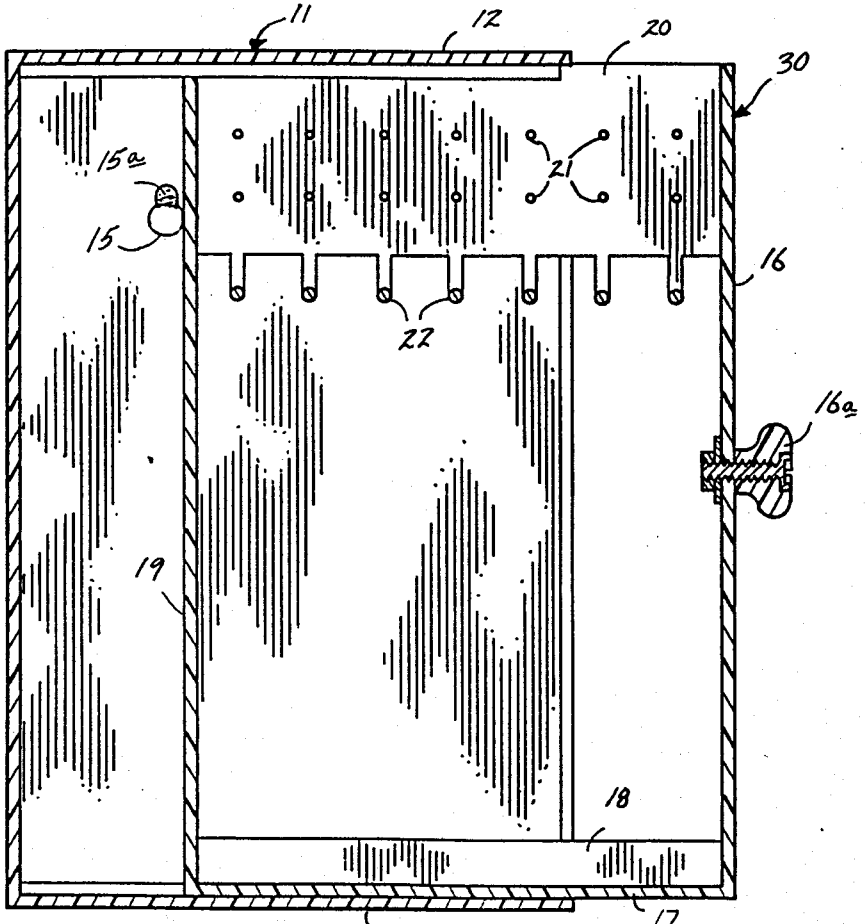
FIG. 6 is an orthographic view taken along the lines 6—6 of FIG. 3 in the direction indicated by the arrows.

More specifically, with particular references to FIGS. 1 to 7, it will be noted that the jewelry storage apparatus 10 essentially comprises a cabinet 11 formed with a horizontal top wall 12 with an equally dimensioned bottom wall **12*a*. A vertical forward wall 13 orthogonally associates the top and bottom wall together with a parallel and equally dimensioned rear wall 14 that has formed therethrough a plurality of securement apertures 15, as illustrated in FIGS. 5, 6, and 7. The securement apertures with reference to FIG. 7, are formed with an adjoining recess 15 wherein a cooperating and downwardly directed flange 15*b* forms part of the rear wall 14 and enables recessed aperture 15*a* to accept a wall fastening connector therein, such as the head of nail or screw, to enable securement of the apparatus 10** to an associated vertical support surface such as a wall.

A forward shelf wall 16 has formed therethrough a knob **16*a* for removal of associated sliding and reciprocating shelf 30 interiorly of the cabinet 11, as illustrated for example in FIG. 1**.

The reciprocating shelf 30 is additionally formed with a shelf floor 17 having integrally and orthogonally secured thereto upwardly coextensive flanges 18 integrally joining the forward shelf wall 16 and a rear parallel shelf wall 19 to define therebetween an interior confined space 17*a* for the positioning and confinement of various miscellaneous jewelry and the like. The upstanding flanges 18 are secured to the shelf floor 17 proximate terminal longitudinal ends 13*a* and 14*a* respectively of shelf floor 17 to slidingly cooperate within respective tracks of lower ends of interior surfaces of respective forward wall 13 and rear wall 14 where. In combination with a beam 20 integrally secured between rear shelf wall 19 and forward shelf wall 16 at upper terminal ends of the rear and forward shelf, shelf 30 walls is guided between a plurality of guide rails 21*a* formed integrally to an interior surface of the top wall 12 to thereby provide a third track in cooperation with the tracks formed by the longitudinal tracks 13*a* and 14*a* of shelf floor 17 to provide three-surface guidance of the reciprocating shelf 30 to the cabinet 11.

The beam 20 has formed therethrough a plurality of openings 21 in a form of parallel rows of openings for positioning of conventional earring posts therethrough in associated pairs between respective upper and lower rows of the openings 21 to provide order and maintenance of such earrings in use.

Additionally, hooks 22 integrally formed to a lower terminal edge of beam 20 are provided for the positioning of various elongate jewelry items, such as necklace items, that may therefore be suspended from the hooks and due to the positioning of the hooks with respect to floor 17, necklaces 50 suspended are in a non-interengaging relationship to maintain order of the aforenoted necklaces.

Conventionally it has been found that the apparatus 10 is of optimum dimension when a depth of two inches of cabinet 11 is provided and with a width of twelve inches measured along the length of top wall 12 with a height of approximately eighteen inches, as measured vertically between the top wall 12 and bottom wall 12*a* along the vertical extent of forward wall 13 to provide a depth/width/height ratio of one/six/nine.

Figure 8:
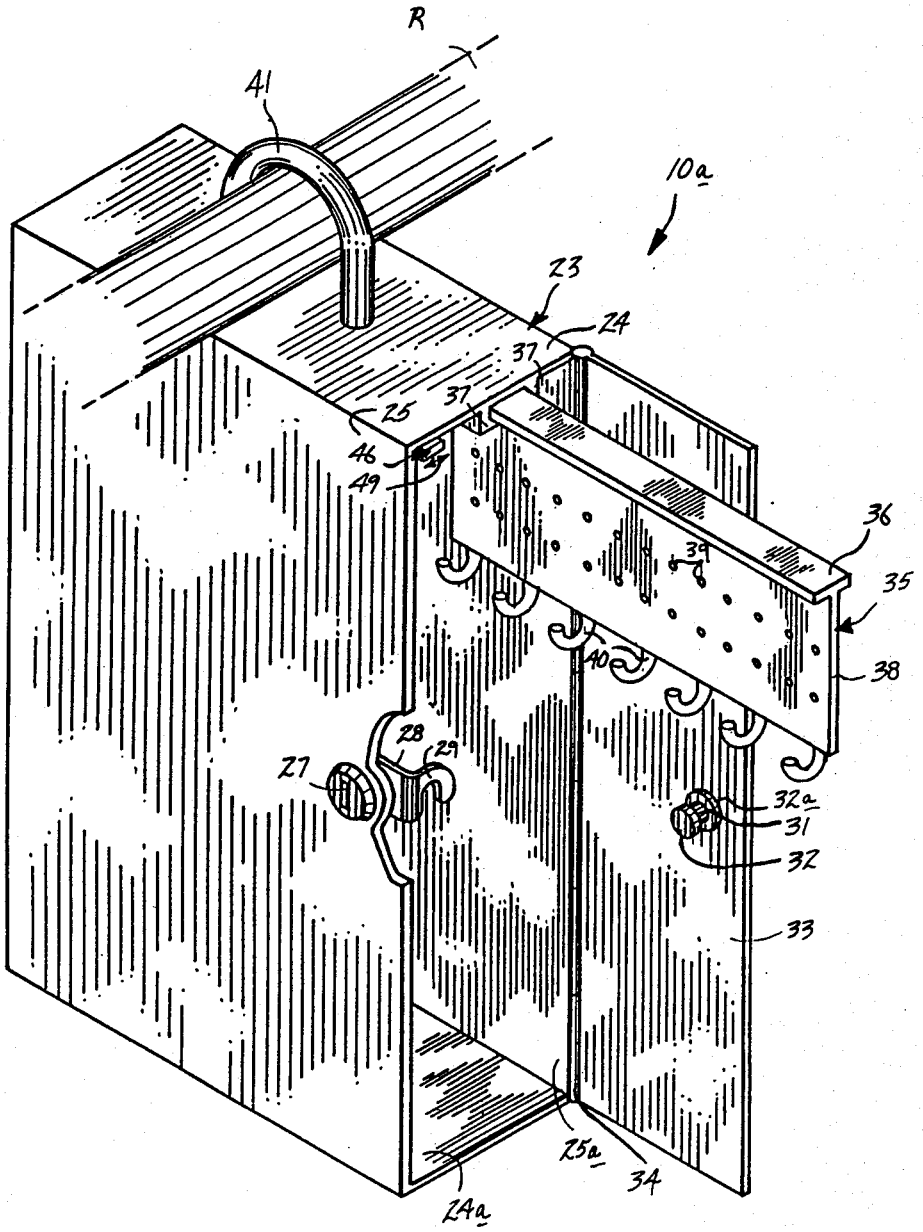
FIG. 8 is an isometric illustration of a modification of the instant invention.
Figure 9:
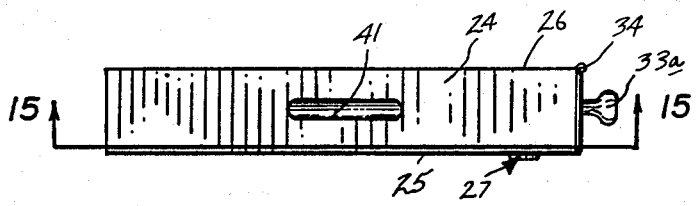
FIG. 9 is a top orthographic view of the invention illustrated in FIG. 8.
Figure 10:
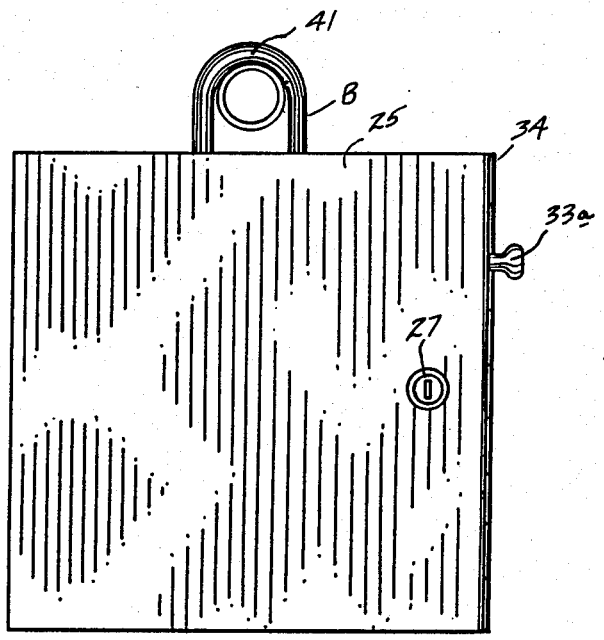
FIG. 10 is an orthographic view taken in elevation of the invention illustrated in FIG. 9.

With reference to FIGS. 8 to 17, a modification of the jewelry storage apparatus depicted as 10*a* is set forth wherein a further cabinet 23 in lieu of a reciprocating shelf 30 as utilized in the apparatus of FIG. 1, utilizes a single "T" shaped reciprocating beam 35 positionable to a first retracted position within the cabinet 23 to a second position exteriorly thereof, as illustrated in FIG. 8.

Figure 15:
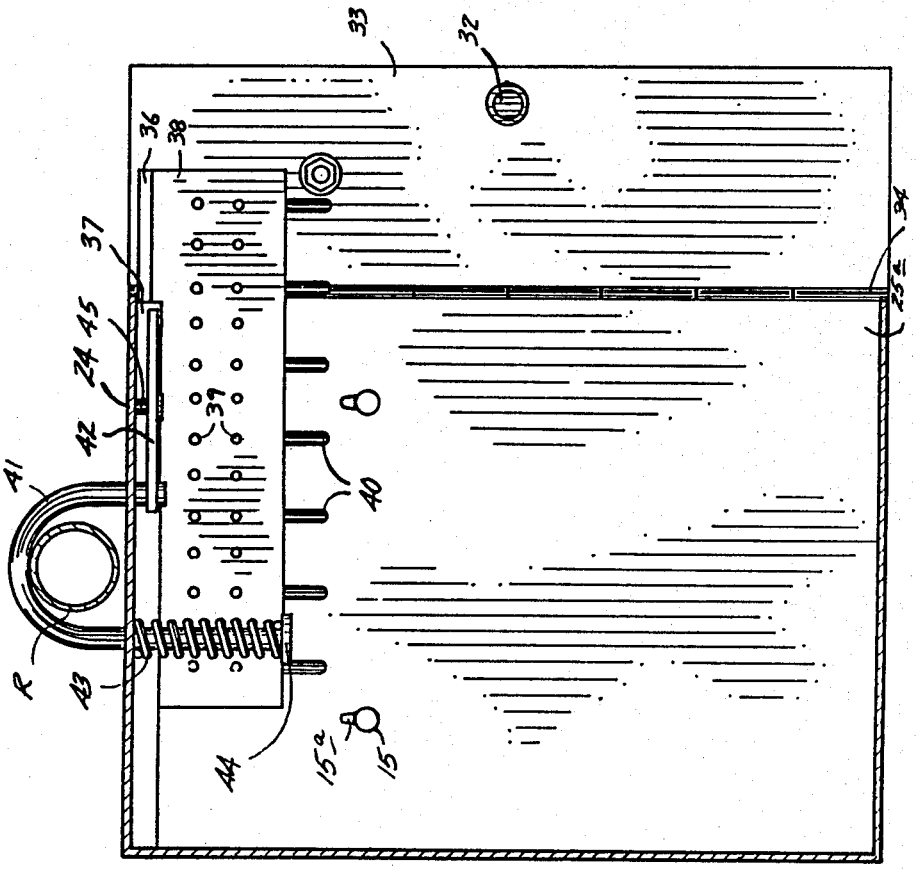
FIG. 15 is an orthographic view taken along the lines 15—15 of FIG. 9 in the direction indicated by the arrows.

A top wall 24 has formed integrally thereto a forward wall 25 and a rear wall 26 formed with equivalent securement apertures and an associated adjoining recess aperture 15 and 15*a* respectively, as illustrated in FIG. 15, of a construction of equivalent to that as illustrated in FIG. 7 of the first embodiment.

Forward wall 25 has formed proximate a vertical forward terminal edge of forward wall 25, a first lock 27 extending through forward wall 25 and pivotally secured to and manipulating an "L" shaped latching member comprising a first leg 28 parallel to forward wall 25 and orthogonally secured to a second leg formed with a downwardly directed "U" shaped recess to cooperate with a boss 31 integrally secured between an enlarged forward head 32 and enlarged rear head 32*a* which is integrally secured to the door 33.

Door 33 has formed thereon a convenient knob 33*a* for pivotally opening said door and providing access interiorly of the cabinet 23 and is formed with a full height piano hinge 34 to provide necessary security of the door 33 and the remaining cabinet structure.

A "T" shaped reciprocating beam 35 is positioned for sliding interrelationship between a plurality of "L" shaped tracks 37 extending longitudinally and formed to interior surface of top wall 24 to define a track formed with a longitudinal space therebetween to accept the beam slidingly 36 therealong wherein each downwardly depending "L" shaped track confront one another to form a gap to enable support 38 to interfit therethrough. Jewelry support 38 is formed with a plurality of rows of parallel spaced openings to accept conventional earring posts, as utilized in contemporary jewelry, and maintain same in a desired order relative to one another.

Secured to a lower terminal edge of support 38 is a series of hooks 40 for positioning of conventional necklaces and the like therein such that the distance between the hooks 40 and a floor 24*a* of cabinet 23 enables the necklaces to be suspended in a tangle-free relationship with respect to one another. In this regard, the depth-/width/height ration of thw cabinet 23 is similar to that as set forth in the first embodiment or of a one/six/nine ratio.

Figure 11:
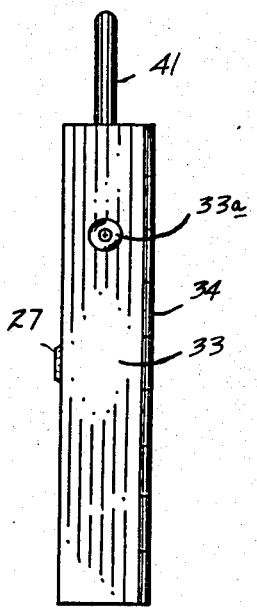
FIG. 11 is an end orthographic view of the invention as illustrated in FIG. 10.
Figure 12:
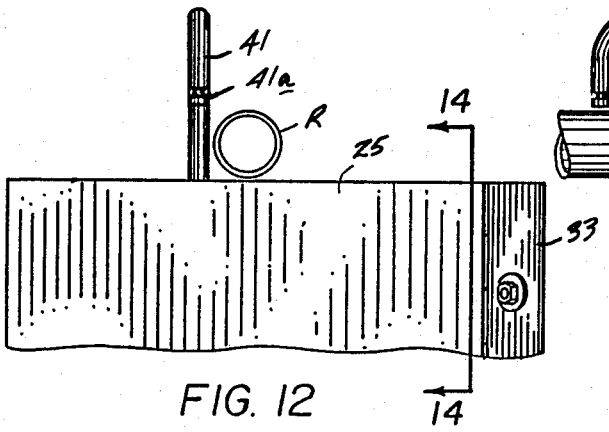
FIG. 12 is an orthographic view taken in elevation of the instant invention illustrating the latching mechanism prior to attachment to an associated horizontal rod.
Figure 13:
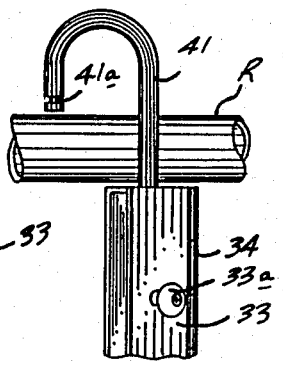
FIG. 13 is an end orthographic view of the invention as illustrated in FIG. 12.
Figure 14:
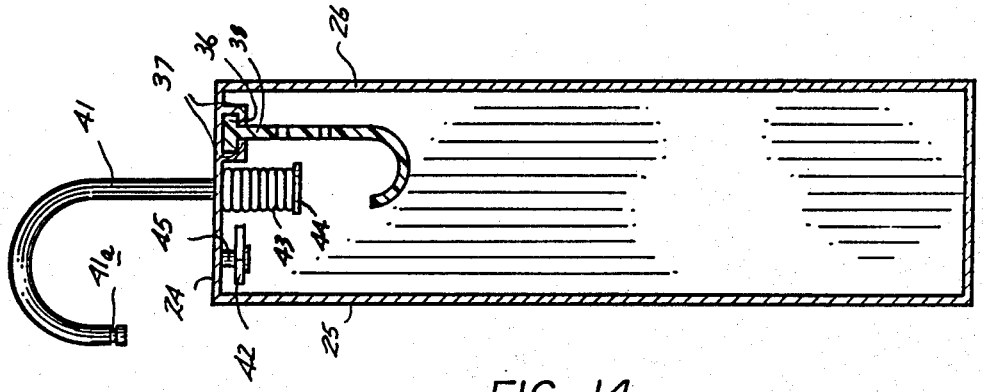
FIG. 14 is an orthographic view taken along the lines 14—14 of FIG. 12 in the direction indicated by the arrows.
Figure 16:
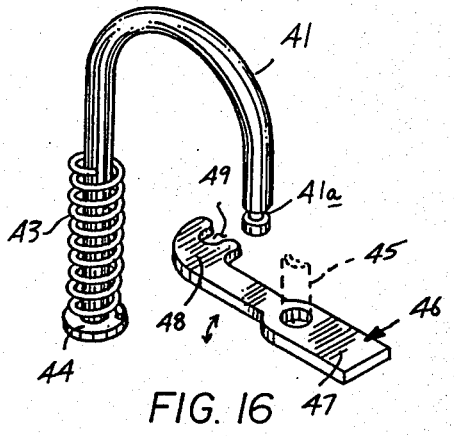
FIG. 16 is an isometric illustration setting forth details of the latching mechanism of the invention illustrated in FIG. 8.
Figure 17:
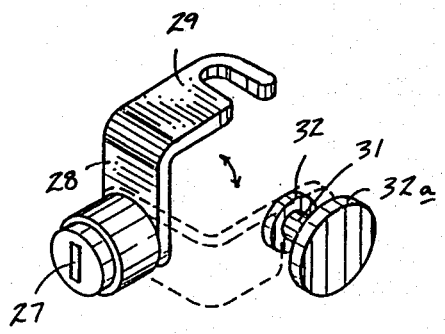
FIG. 17 is an isometric illustration of the door latching mechanism as illustrated in FIG. 8.

With attention to FIGS. 8, 15 and 17, a second lock 41 to cooperate with a "U" shaped clamp 41 is illustrated. The "U" shaped clamp 41 is positioned and arranged to cooperate with a conventional rod "R", as may be found in clothes closets and the like, to enable temporary and secure mounting of the apparatus 10*a* during travel by users thereof. The second lock 41 is formed with a reduced shank 41*a*, as illustrated in FIGS. 11, 14 and 16, for example, to cooperate with an internal latch 46 pivotally secured between pivot pin 45 integrally formed to interior of top wall 24. The internal latch 46 is formed with a handle 47, as illustrated in FIG. 16, at one end onto one side of pin 45 with a bifurcated head at a second end to the opposite side of pivot pin 45 orthogonally directed to handle 47. Upon pivoting of the internal latch 46 in the direction of arrow 49, as illustrated in FIG. 8, the latch 46 may engage and disengage the reduced shank 41*a* formed proximate a first terminal end of one leg of the "U" shaped clamp of second lock 41 wherein a coil spring 43 is captured between a head 44 integrally formed to a longer and second leg of the second lock 41 to thereby capture the second lock 41 between an internal surface of top wall 24 and the head 44.

The use of the embodiment as set forth in FIGS. 8 through 17 is self-explanatory. A traveler upon entering a convenient motel room or the like may secure second lock 41 about an existing clothes hanger rod "R" and by more pivoting of the internal latch 46 in direction proximate forward wall 25 the bifurcated head 48 will engage the reduced shank 41*a* of second lock 41 and thereby secure the apparatus 10*a* to the rod "R". Upon positioning of the various jewelry to the provided openings 39 and hooks 40, as well as positioning of miscellaneous jewelry upon the floor 24*a*, the "T" shaped reciprocating beam 35 is directed to a first position internally of the cabinet 23 and the second lock 27 is pivoted by means of a convenient key of conventional construction (not shown) to pivot the second orthogonal leg, as illustrated in FIG. 17, to a phantom position, as illustrated in FIG. 17, to engage boss 31 and capture the second orthogonal leg and associated "U" shaped recess between the respective forward boss 32 and rear boss 32*a*.

The manner of usage and operation therefore of the instant invention should be apparent from the above description and accordingly no further discussion relative to the manner of usage and operation will be presented.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jewelry storage apparatus comprising a vertically elongate cabinet including a top wall, a bottom wall, a forward wall, a rear wall, and a first side wall defining a cabinet and a jewelry storage means slidably and reciprocatably mounted in said cabinet from a first position within said cabinet to a second position externally of said cabinet for access to a user, and said storage means mounted to a plurality of spaced depending "L" shaped guide rails secured to an interior surface of said top wall, and said storage means comprising a "T" shaped beam including an elongate head slidably supported on each of said guide rails and an elongate planar jewelry support integrally and orthogonally depending downwardly from said head of a thickness approximately equal to a spacing between said guide rails, and said elongate planar jewelry support including a lower terminal edge spaced above bottom wall, and a door hingedly mounted to said rear wall to enclose said storage means when retracted within said cabinet to said second position, and wherein said apparatus further comprises a first lock pivotally secured to said forward wall and including an "L" shaped latching means securable to a boss means integrally formed to interior surface of said door, and wherein said apparatus further comprises a second lock means including a "U" shaped member extending externally of said top wall for securement to an external post wherein said "U" shaped member includes a first leg formed with a reduced shank for interengaging association with an internal latch, said internal latch pivotally secured within said cabinet, and said "U" shaped second lock including a second leg of a length greater than said first leg formed with a head at a terminal end to capture a spring biasing means between said head and surface of said top wall for biasing said "U" shaped second lock means outwardly of said top wall, and wherein said jewelry support includes a plurality of hooks therebelow, secured to said lower terminal edge thereof for securement of elongate jewelry members and further including plural rows of apertures through said jewelry support for securement of earring posts thereto.

* * * * *